US006898154B1

(12) United States Patent
Sheu

(10) Patent No.: US 6,898,154 B1
(45) Date of Patent: May 24, 2005

(54) CLOCK-DRIVING DEVICE COMBINED WITH A CONVENTIONAL CORE

(76) Inventor: Kuei-Wen Sheu, 3F., No. 30, Alley 69, Lane 166, Sec. 1, Shihpai Rd., Beitou District, Taipei City (TW)

( * ) Notice: Subject to any disclaimer, the term of this patent is extended or adjusted under 35 U.S.C. 154(b) by 0 days.

(21) Appl. No.: 10/719,367

(22) Filed: Nov. 21, 2003

(51) Int. Cl.[7] ..... G04B 19/02; G04B 19/04; G04C 21/00

(52) U.S. Cl. ..... 368/76; 368/80; 368/222; 368/235

(58) Field of Search ..... 368/76–80, 223, 368/233–235

(56) References Cited

U.S. PATENT DOCUMENTS 4,005,570 A * 2/1977 Miyamoto et al. ..... 368/72
4,298,972 A * 11/1981 Ogihara et al. ..... 368/222
5,274,616 A * 12/1993 Shu ..... 368/39

* cited by examiner

*Primary Examiner*—Vit W. Miska
(74) *Attorney, Agent, or Firm*—Alan D. Kamrath; Nikolai & Mersereau, P.A.

(57) ABSTRACT

A clock-driving device combined with a conventional core that takes advantage of conventional quartz oscillation comprises providing a magnet on the hand of the conventional core and providing a reed sensing device in the moving path of the magnet. When the magnet enters the sensing region of the reed sensing device, an electric communication path will be generated periodically and trigger the startup of the motor to drive a micro-motive device as well as to rotate the main mandrel to output power. As the motor driving said rotational mandrel to accomplish one action, said micro-motive device will interrupt the electric communication path so as to save electric power.

6 Claims, 6 Drawing Sheets

CLOCK-DRIVING DEVICE COMBINED WITH A CONVENTIONAL CORE

BACKGROUND OF THE INVENTION

1. Field of the Invention

The invention relates to a clock-driving device combined with a conventional core and in particular, to clock-driving device combined with a conventional core that takes advantage of the oscillation mode of a traditional quartz oscillator, wherein, a magnet is provided on its hand and, as the magnet enters the sensing region of a reed sensor, a periodic sensing path can be generated and triggers the startup of a motor to drive a micro-motive device, and a rotational mandrel to output; as the action finished, the micro-motive device will disconnect the path to save electrical power.

2. Description of the Prior Art

The ingredient of quartz is silicon dioxide (SiO2). When quartz is placed in an oscillating circuit and under a specific condition, it can transfer its own frequency into the circuit. A traditional core device takes advantage of this specific feature of quartz and converts electric energy into kinetic energy via a quartz oscillator. The circuit board is typically mass-produced using a mechanized equipment, which, after incorporated in resistors and capacitors, becomes a finished product. Since quartz oscillator core has been used in practice for several tens years, its production techniques is well established and besides, its price is quite low. In addition, conventional quartz oscillator has several advantages including accuracy, low weight and easiness for maintenance.

Since driving structures used in a conventional digital clock comprises of employing a coil motor to drive said device, in order to achieve automatic changes of minute, hour, date, month, week, and year, the structure needs always a number of mechanical control parts for engagement and control. Under these circumstance, in case of using common batteries to power the structure, too much electric power might be consumed to result in frequent replacement of batteries and hence cause inconvenience in life and waste of resources. Furthermore, because the coil motor used in the structure of a conventional digital clock must produce horse power for generating clock, driving coil, and activating minute sheet, hour sheet, date sheet, month sheet, week sheet and year sheet, events such as insufficient electric power might occur frequently and thus could incur poor performance of that digital clock as well as too much consumption of electric power.

In addition, if a large size hanger clock or wall clock or digital clock is required in response to a special requirement, the conventional fabrication way comprises scale up the whole clockworks, from motor to running gears, in accordance with an appropriate proportion. These would result in not only material- and time-consuming, but also increasing of price at higher proportional as well as inconvenience for future maintenance.

Thus, it can be seen that the above-described conventional articles have still many disadvantages, and not of a perfect design, which need improvement at once.

In view of the above-mentioned disadvantage associated with the conventional structure, the inventor had thought to solve and improve by combining with the structure of a conventional quartz oscillator core, and, finally, after studying extensively for many years, developed successfully the clock-driving device combined with a conventional core.

SUMMARY OF THE INVENTION

Accordingly, one object of the invention is to provide a clock-driving device combined with a conventional core, characterized in that it is a core device of conventional quartz oscillating mode and hence renders the invention to have advantages as low cost and stable frequency.

Another object of the invention is to provide a clock-driving device combined with a conventional core, characterized in that a reed sensor is provided on the hand of a conventional core structure, and, thereby the reed sensor can sense the periodic motion of the hand to trigger the motor periodically such that the electric power can be saved accordingly.

Yet another object of the invention is to provide a clock-driving device combined with a conventional core, characterized in that is can calculate the clock by means of the conventional core structure and that the motor for the output rotation mandrel uses a separate energy source to save the electric power.

The clock-driving device combined with a conventional core that can achieve the above-mentioned objects is consisted of a conventional core device, a magnet, a reed sensing device, a driving motor, a micro-motive device, an output rotational mandrel and two set of batteries, wherein said magnet is provided on a hand of said conventional core device, and said reed sensing device is embedded at an appropriate position such that as the magnet moves associated with the periodical motion of said hand and enters the sensing region of said reed sensing device, a sensing path can be generated periodically, which in turn triggers the motor, and at the same time, interrupts the circuit by means of said micro-motive device such that the rotational output can be adjusted and controlled stably and efficiently into a constant clock as well as can save the electric power.

The clock-driving device combined with a conventional core provided by the invention has following advantages:

1. A property of stable frequency from conventional core device by providing a magnet on the hand of the conventional core to trigger stably a reed sensing device and driving the motor.
2. By interrupting the sensing path with a micro-motive device to save electric power and achieve the effect of extending the service life of the battery.
3. Since the motor is triggered to drive before acting without being kept always at a ready state, the service life of the clockworks can be extended.
4. Since the power supply used in the invention can be divided to each respective motor provided for driving sheets of minute, hour, day, month, year and the like, respectively, for drive large size sheets or large size hands of a wall clock, it can be done by just replacing the motor and power supply thereof.
5. The invention can use a single power supply and hence simplify the equipment.

BRIEF DESCRIPTION OF THE DRAWINGS

The drawings disclose an illustrative embodiment of the present invention which serves to exemplify the various advantages and objects hereof, and are as follows.

REPRESENTATIVE SYMBOLS IN THE DRAWINGS

Figure 1:
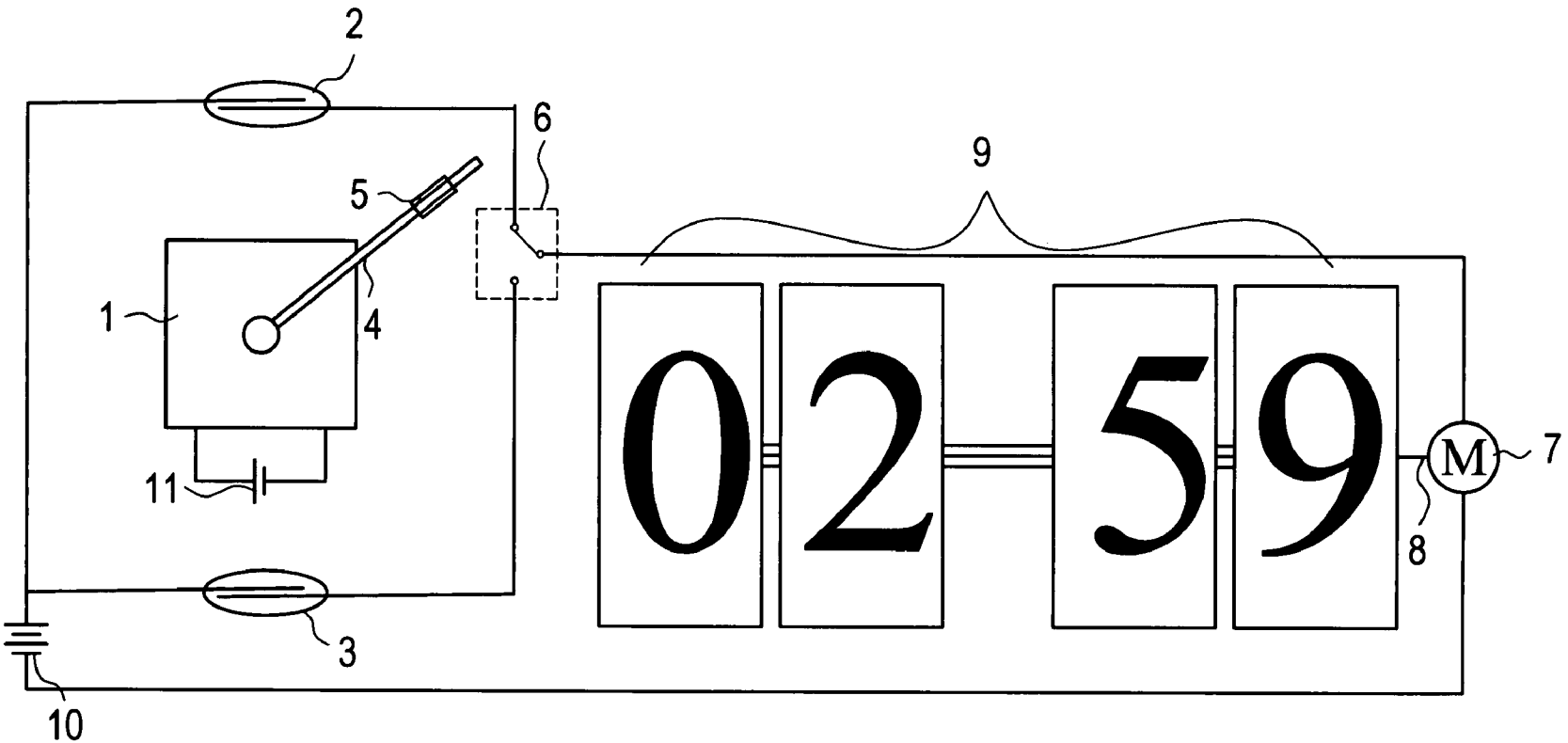
FIG. 1 is a schematic view of one embodiment of the clock-driving device combined with a conventional core according to the invention.

1 Conventional core
2 Reed sensing device
3 Reed sensing device
4 Second hand
5 Magnet
6 Micro-motive device
61 Micro-switch
62 Gear
63 Protuberance
64 Teeterboard member
65 Button
7 Motor
8 Output rotational mandrel
9 Sheet
10 Battery
11 Battery

DETAILED DESCRIPTION OF THE PREFERRED EMBODIMENT

In order to better understand the structure, use and characteristics of the invention, the invention will be described in detailed with reference to two non-limiting example in conjunction with accompanying drawings as follows.

Referring to FIG. 1, a schematic view illustrating the layout of the clock-driving device combined with a conventional core according to the invention, comprises a conventional core device 1 with its own power supply 11 separated from the power supply 10 associated with a motor 7 loop; a small magnet 5 provided on the second hand 4 of the conventional core device 1 and moving in combination with the second hand 4, that is, under this situation, the speed of the magnet 5 being 1 round per minute; reed sensing devices 2 and 3 provided diagonally with each other in the moving path of the magnet 5 such that, as the magnet 5 enters the sensing region of the reed sensing device 2 or 3, it will be sensed and an electric communication is thus generated to trigger the operation of the motor 7, i.e., 2 electric path generated per minute to trigger the operation of the motor 7, while during rest time, the motor 7 loop is interrupted so as to save electric power; and a micro-motive device 6 for controlling and examining the whole loop such that the 2 paths per minute is converted to a constant radian per minute and that the motor 7 is operated correspondingly to drive a output rotational mandrel 8 and the associated flipping of pure digital sheets 9, wherein said sheet 9 can display minute, hour, date, month and year, as minute and hour displayed in FIG. 1. The output rotational mandrel 8 accomplishes one action per minute and flips once the sheet of the unit place minute. For every ten time the unit place minute sheet flipped, the tens place minute sheet will be brought to flip once and for every six times the tens place minute sheet flipped, the unit place hour sheet will be brought to flip once and the forth. These can be coupled with the conventional core device 1 and displays accurate time synchronously.

Figure 2:
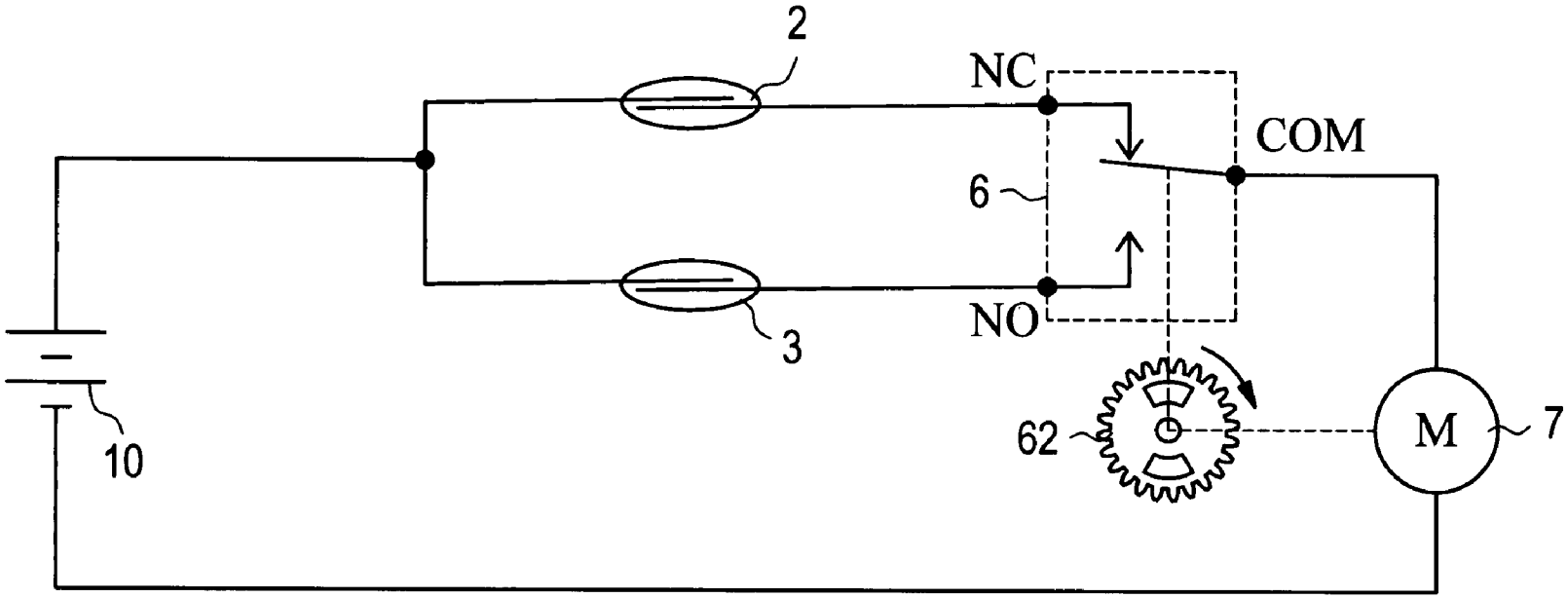
FIG. 2 is a schematic view of the driving motor loop in the clock-driving device combined with a conventional core.

Now referring to FIG. 2, the loop of the motor 7 is illustrated schematically therein. The reed sensing device 2 is connected in series to the normally closed terminal NC of the micro-motive device 6 and is connected in parallel to the reed sensing device 3 that is connected in turn in series to the normally opened terminal NO of the micro-motive device 6. Whereas the reed sensing device 3 that is connected in series to the normally opened terminal NO of the micro-motive device 6 is connected in series to a common terminal COM of the micro-motive device 6. Thus, as the magnet 5 enters the sensing region of the reed sensing device 2, said reed sensing device 2 will sense it and generates a communication path to trigger the motor 7. The motor 7, in addition to rotate the output rotational mandrel 8, engages also the gear 62 of the micro-motive device 6. The gear 62 of the micro-motive device 6 will then bring the switching of the micro-motive device 6 to its normally opened terminal NO to interrupt the original communication path. The next communication path of the motor 7 will be generated from the sensing of the reed sensing device 3 that is connected in series to the normally closed terminal NO of the micro-motive device 6 and will be interrupted upon the switching of the micro-motive device 6 to its normally opened terminal NO, and this cycle will be repeated so on.

Figure 3:
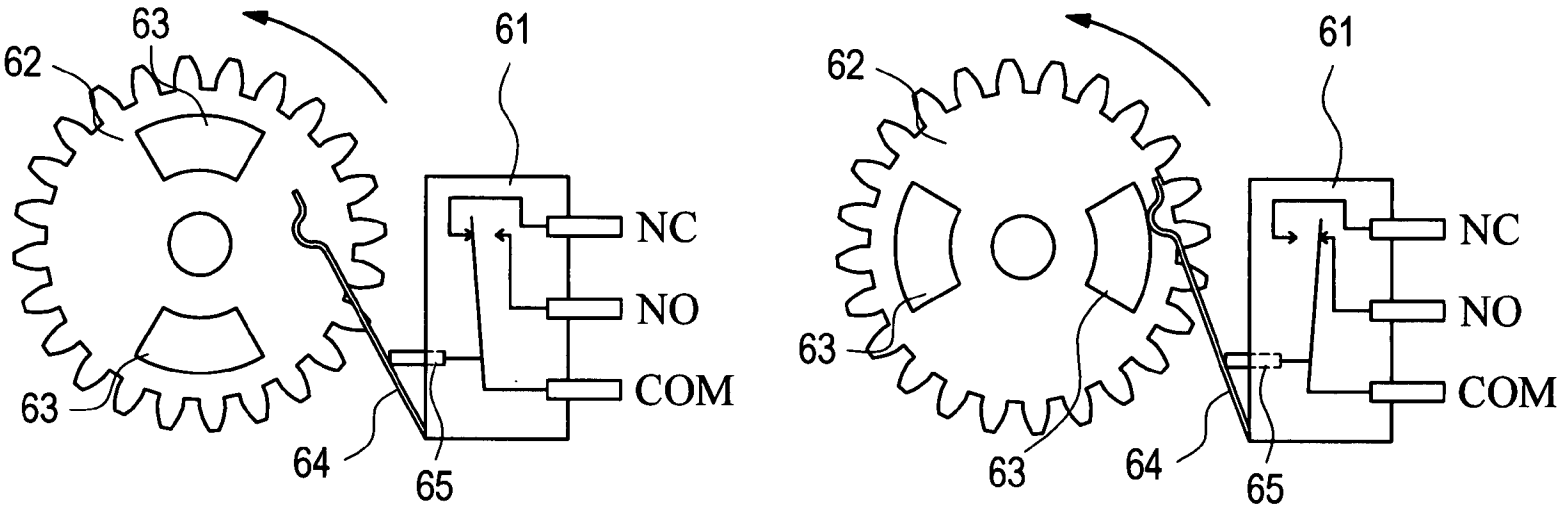
FIG. 3 is a schematic view illustrating the action of the micro-motive device in the clock-driving device combined with a conventional core according to the invention.

Referring to FIG. 3, a schematic view illustrates the operation of the micro-motive device 6. The motor 7 drives the rotation of the gear 62. A protuberance 62 is provided at a suitable position on the gear 62. When the gear 62 rotates, the protuberance 63 will drive a teeterboard member 64 which, by pressing down the button 65 of a micro-switch 61, can in turn switch over the normally opened terminal NO and normally closed terminal NC of the micro-motive device 6.

Figure 4:
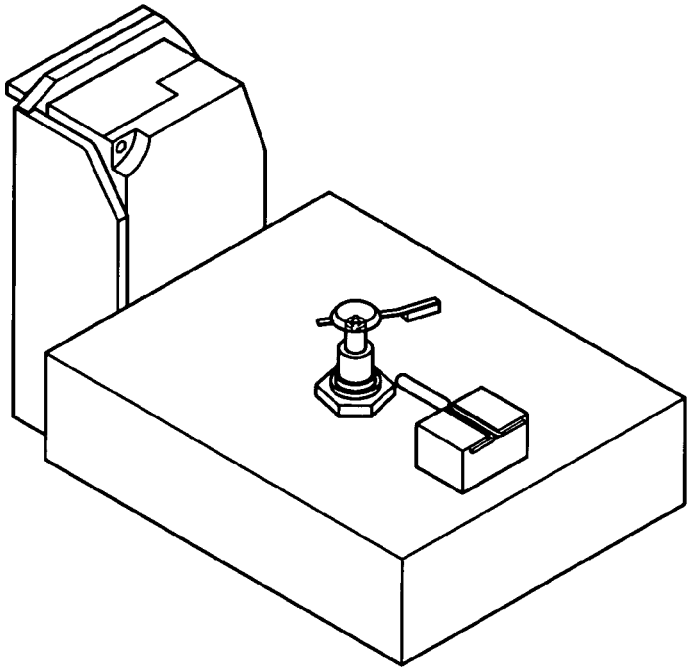
FIG. 4 is a schematic view of another embodiment of the invention.

Referring to FIG. 4, showing another embodiment of the invention, the reed sensing device 3 is removed and the reed-sensing device 2 is connected in series to the normally opened terminal NO of the micro-motive device 6 with an additional circuit.

Figure 5:
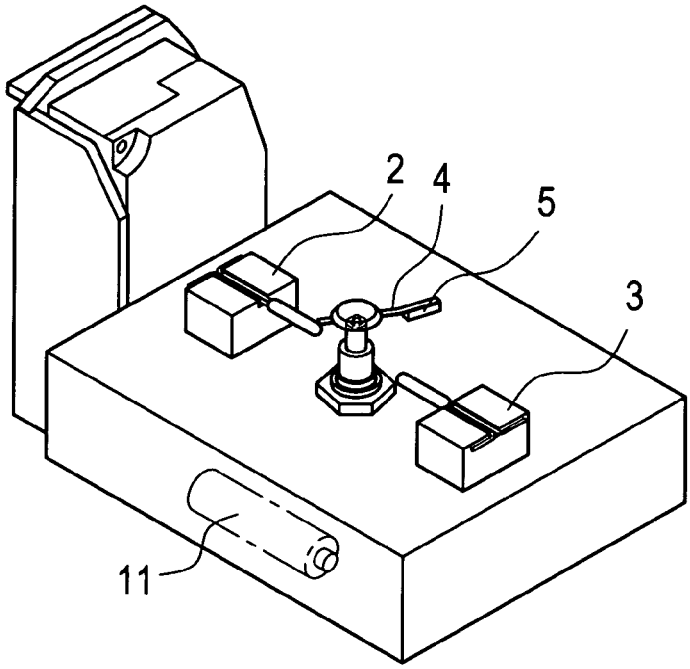
FIG. 5 is a schematic view of a preferred embodiment of the invention.
Figure 6:
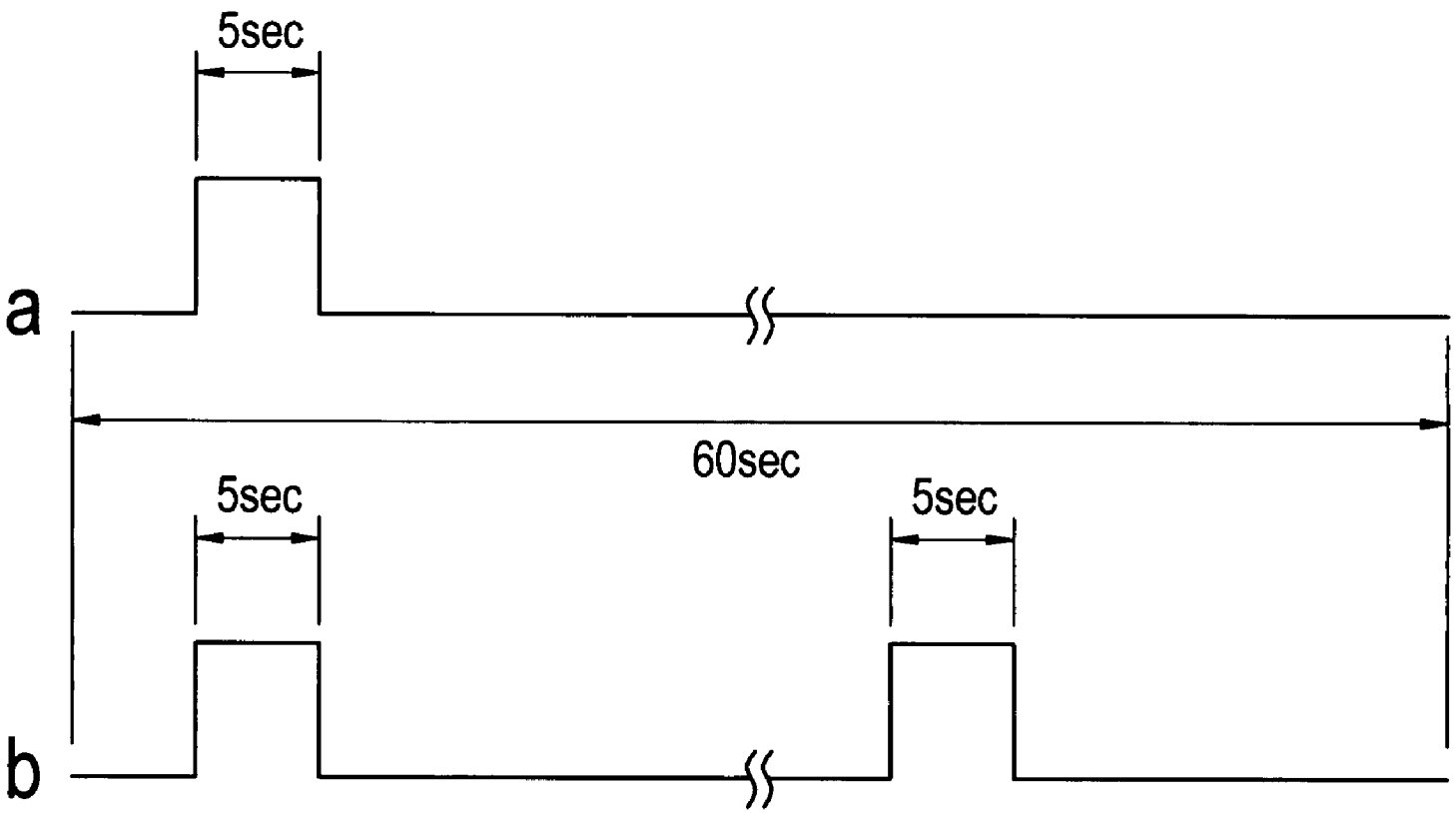
FIG. 6 is a schematic view showing clock sensing in another preferred embodiment of the invention.

Referring to FIG. 5, a schematic view illustrates this embodiment corresponding to the above description. The clock output from sensing of both is shown and compared in FIG. 6. FIG. 6*a* shows the clock output from the sensing of another embodiment of the invention. FIG. 6*b* shows the output clock from the sensing of this embodiment.

Similarly, the battery 11 of the conventional core 1 can be removed and the electric power is supplied instead from the battery 10 to achieve the purpose of simplification.

Figure 7:
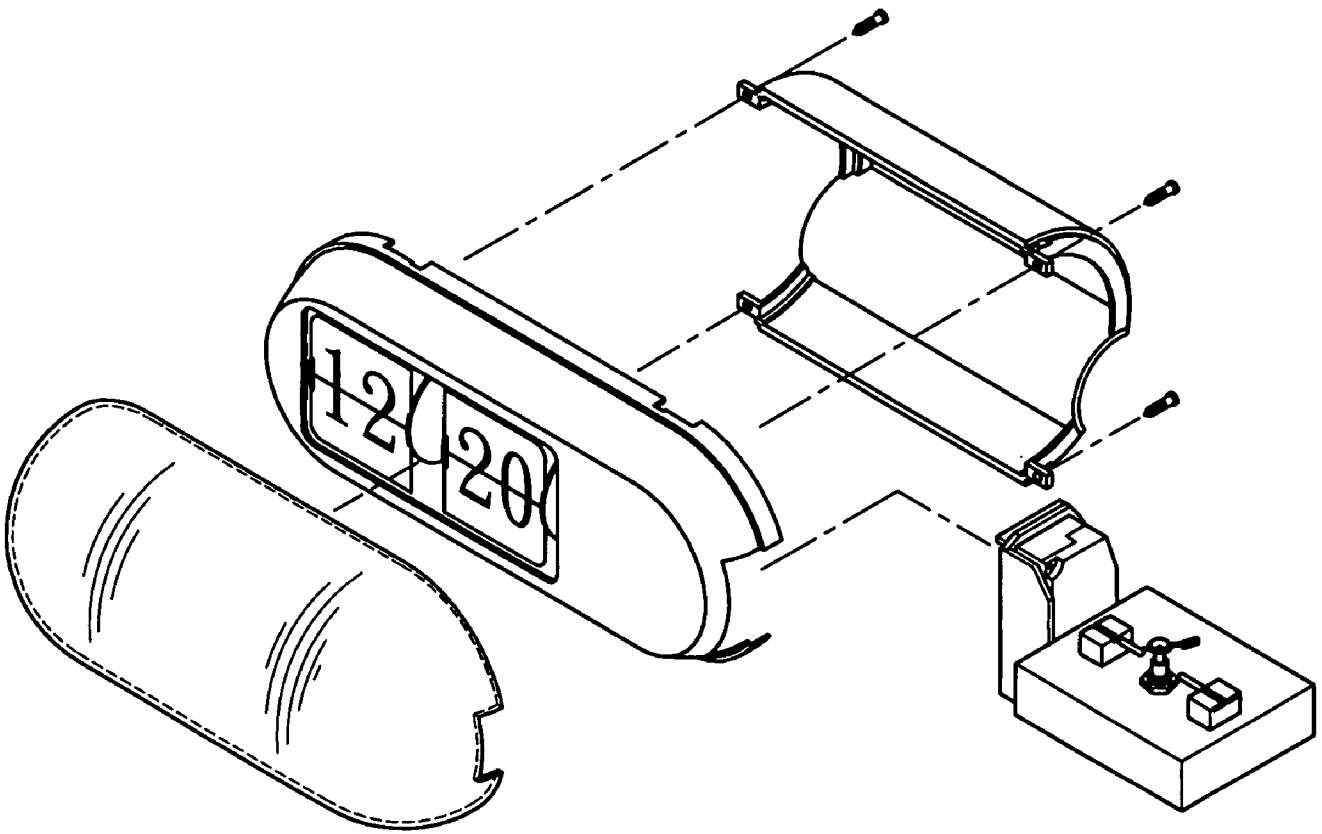
FIG. 7 is a schematic view illustrating the equipment of a preferred embodiment of the invention.

Referring to FIG. 7, a schematic view illustrates the layout of the clock-driving device combined with a conventional core according to the invention.

It should be appreciated that while the invention is described with reference to its preferred embodiments in the forgoing, these embodiments are not intended to limit the scope of the invention and those equivalents or variations without departing from the spirit of the invention are intended to be encompassed within the scope of the appended claims.

According to the forgoing, it is evident that the invention is novel in terms of the space pattern, and meets the requirement of patentability of novelty and advancement, and therefore, the application is filed accordingly.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A clock-driving device combined with a conventional core, comprises:

a conventional core device, operated with a conventional core and displaying time with hands including a second hand;

a power supply, for supplying electric power to said core and a motor;

a magnet, provided at an appropriate position on the second hand of said conventional core device;

a reed sensing device, provided at an appropriate position on said conventional core;

a motor, provided in the same loop as the reed sensing device such that it can be triggered to rotate and output rotational mandrel;

a micro-motive device, comprising a micro-switch having a button, a teeterboard member and a gear engaged with said motor to drive the output rotational mandrel, wherein a protuberance is provided on said gear, and wherein as the teeterboard member is driven to press down or release the button, the micro-switch will be switched and thus change the communication path of the motor loop;

wherein, by providing said magnet on the hand of said conventional core, and providing said reed sensing device at a suitable position in the moving path of said magnet, as said magnet enters the sensing region of said reed sensing device, sensing said magnet by said reed sensing device will generate a communication path, and then trigger said motor to drive said micro-motive device as well as to rotate the output rotational mandrel; and wherein, as said motor driving said rotational mandrel to accomplish one action, said micro-motive device will interrupt said communication path so as to save electric power.

2. A clock-driving device combined with a conventional core as recited in claim 1, wherein more than one of said reed sensing devices are provided.

3. A clock-driving device combined with a conventional core as recited in claim 1, wherein different type of said motor and power supply are employed depending on the size of a clock so as to supply sufficient driving power.

4. A clock-driving device combined with a conventional core as recited in claim 1, wherein said conventional core uses a same power supply with said motor to achieve the purpose of simplification.

5. A clock-driving device combined with a conventional core as recited in claim 1, wherein said conventional core uses a power supply different with the power supply used by said motor to extend the service life of the battery.

6. A clock-driving device combined with a conventional core as recited in claim 1, wherein said protuberance on said gear of said micro-motive device is provided at various position and radian to adjust output clock.

* * * * *